US006352180B1

(12) United States Patent
Reyhons

(10) Patent No.: US 6,352,180 B1
(45) Date of Patent: Mar. 5, 2002

(54) LONG HANDLED CONDIMENT DISPENSER

(76) Inventor: Margaret M. Reyhons, 4634 Mirada Way #26, Sarasota, FL (US) 34328

( * ) Notice: Subject to any disclaimer, the term of this patent is extended or adjusted under 35 U.S.C. 154(b) by 0 days.

(21) Appl. No.: 09/389,931

(22) Filed: Sep. 3, 1999

(51) Int. Cl.[7] ..... A47G 19/12

(52) U.S. Cl. ..... 222/142.1; 222/174; 222/196.1; 452/146

(58) Field of Search ..... 222/142.1, 142.6, 222/142.9, 196.1, 174, 191, 465.1, 565, 153.09, 143; 452/146

(56) References Cited

U.S. PATENT DOCUMENTS

| | | | | | |
|---|---|---|---|---|---|
| 142,670 | A | * | 9/1873 | Bird | 222/143 |
| 525,942 | A | | 9/1894 | Bowen | 222/174 |
| 917,804 | A | * | 4/1909 | Sedgwick | 222/143 |
| D45,584 | S | * | 4/1914 | Broaddus | 222/142.1 |
| 1,155,802 | A | | 10/1915 | Dennis | 222/142.2 |
| 1,608,865 | A | | 11/1926 | Ryder | 222/467.5 |
| 1,632,540 | A | | 6/1927 | Clark | |
| 1,774,904 | A | * | 9/1930 | Scully | 222/142.1 |
| 2,019,009 | A | * | 10/1935 | Hendrix | 452/146 |
| 2,187,245 | A | * | 1/1940 | Nerney | 222/142.1 |
| 2,601,087 | A | | 6/1952 | Bludeingen | |
| 2,733,839 | A | | 2/1956 | Blum | 222/174 |
| 4,380,307 | A | * | 4/1983 | Stillinger | 222/142.9 |
| 4,414,885 | A | * | 11/1983 | Kelly | 99/494 |
| 4,418,819 | A | | 12/1983 | Shapiro | 206/216 |
| 4,691,822 | A | | 9/1987 | Malancon, Jr. | 222/465.1 |
| 5,526,966 | A | | 6/1996 | Lutzker | 222/480 |
| 5,593,346 | A | * | 1/1997 | Washington | 452/146 |

* cited by examiner

*Primary Examiner*—Lesley D. Morris
*Assistant Examiner*—Melvin Cartagena
(74) *Attorney, Agent, or Firm*—Mark Douma

(57) ABSTRACT

A condiment dispenser that has a handle of sufficient length to reduce the forces necessary to dispense condiments and/or make the dispenser safe to use over a backyard barbecue grill. In one version, one end of the handle has an attached cylinder having grooves or slots and two or more condiment containers have protrusions that engage the slots so that the containers may be mounted and de-mounted as in a bayonet coupling. Opposite the protrusion end, the containers have lids and rotatable tops, each having a hole or holes that allow regulation of the flow of condiments out of the containers. Another version uses a unitary lid and top having multiple protrusions and at least one hole, so that when secured to the handle, tenderizing and marinading can be undertaken at the same time. Other versions relate to various ways of securing the condiment containers to the handle.

18 Claims, 2 Drawing Sheets

LONG HANDLED CONDIMENT DISPENSER

BACKGROUND

1. Technical Field

This invention relates to a condiment, e.g., salt and pepper, dispenser that is safe and convenient for flavoring foods being cooked at backyard barbecues, in kitchens, and the like.

2. Background

The word barbecue is derived from the Spanish word barbacoa that early explorers applied to a rack that American Indians used to preserve food by smoking. With modem refrigeration, this is not necessary, but barbecuing has become increasingly popular as a food preparation method, especially after World War II. According to one source, 5.5 million people now attend barbecue cook-offs every year. At present, there is at least one niche-market store chain devoted solely to barbecue equipment and supplies.

Barbecuing is an integral part of many family occasions. In these settings, while not really a game, children often would like to assist in food preparation to some extent. The easiest activity for them is to apply condiments. However, there is some danger in this because of the open heat, creating at least anxiety on the part of parents. Although there must be thousands of different condiment dispensers, none are well suited for flavoring food over a barbecue. Typically, one grasps the body of the container with the dispensing end facing the thumb and reaches over the barbecue. For short people, there is the discomfort of high heat and the risk of burns from ignited dripping fat. There are isolated instances of condiment dispensers that have short handles dictated by a container shape that is not amenable to grasping. These design were never intended to and do not solve the problem presented by a barbecue. Other disadvantages of the prior art will become more apparent after a description of the advantages of the present invention.

SUMMARY

Accordingly, one object of the present invention is to provide a condiment dispenser that can apply condiments to food being cooked over a barbecue grill while exposing the user to a minimal amount of heat.

Another object is to provide a condiment dispenser that can apply condiments with greater control using less force than currently available dispensers.

These objectives are realized by a condiment dispenser having at least one condiment container and a long handle secured to it. Preferably the length of the handle is at least six inches and more preferably at least nine inches. The securing of the container to the handle may be either permanent or de-mountable.

In one version, attached to one end of the handle is a cylindrical holder that has grooves inside or slots in the wall that provide a locking mechanism for protrusions on two cylindrical condiment containers that are twist-locked into the holder with their bottoms inside and their dispensing ends facing away from each other. Lids and rotatable tops allow filling the containers and regulating the flow.

As a modification of this version, a lid having a plurality of pyramidal protrusions and having at least one hole can be used as a combination tenderizer and marinader.

Other methods of securing condiment containers to the handle include, but are not limited to, screw threads, circular clamps, and frictional fits.

DETAILED DESCRIPTION

Figure 1:
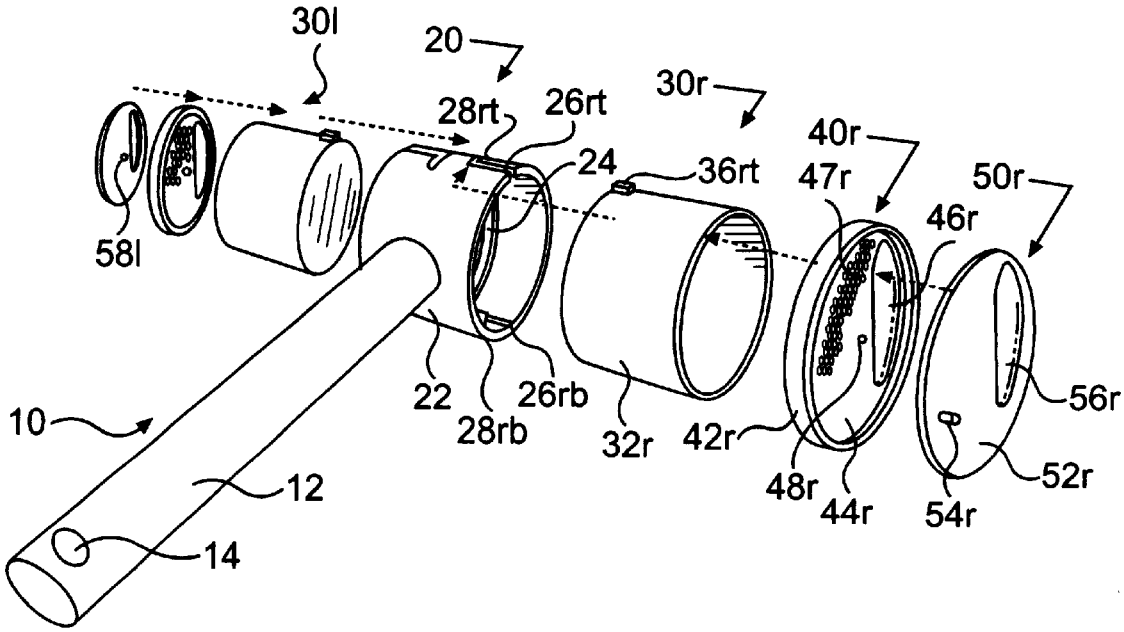
FIG. 1 shows an exploded perspective view of one embodiment of the invention as a dual condiment dispenser.
Figure 2:
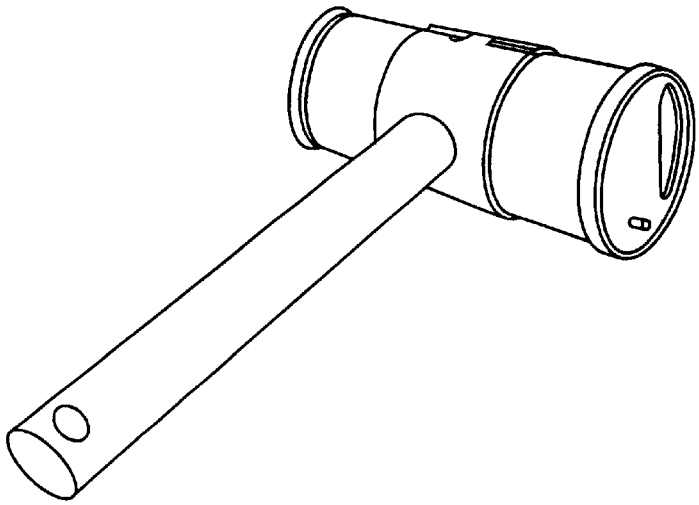
FIG. 2 shows a perspective view of the dispenser of FIG. 1.

One preferred embodiment of the invention is illustrated in FIGS. 1 and 2. This particular embodiment has two condiment dispensers, one on the right and one on the left, with respect to the drawings. As illustrated, they are identical and the one on the right will be explained. To avoid confusion, herein below, the individual condiment dispensers will be designated as "condiment containers" and "dispenser" used for the overall article.

A handle 10 comprises a cylindrical rod 12 having a hole 14 that traverses the rod 12, at one end, and the other end is attached to a container holder 20. In mass production, the handle 10 and holder 20 would most likely be a single molded plastic piece. The container holder 20 comprises a cylindrical sleeve 22 that has relatively thin walls and an inside rib 24 located approximately equidistant from the ends of the sleeve 22. The walls of the sleeve 22 have slots, top and bottom with respect to the paper, 26*rt* and 26*rb*, respectively, that connect with right angle slots 28*rt* and 28*rb*, respectively.

A demountable condiment container is comprised of a body 30*r*, a lid 40*r*, and a rotatable top 50*r* ("top" is used in the sense of a closure and not as to location). The body 30*r* comprises a cylindrical cup 32*r* having a bottom (visible on the corresponding 301) closing the end proximate the holder 20*r* and having a locking protrusion 36*rt* and a diametrically opposite one 36*rb* (not shown). This forms what is commonly called a bayonet coupling.

The open end of body 30*r* is closed with the lid 40*r* comprising a relatively short cylindrical sleeve 42*r* surrounding a circular plate 44*r* that has an opening 46*r*, a plurality of holes 47*r*, and central pivot hole 48*r*. The plurality of holes generally occupies a position and area corresponding to a 120° rotation of the opening 46*r*. The rotatable top 50*r*, functioning as a condiment flow controller, comprises a circular plate 52*r* having a finger operable protrusion 54*r*, an opening 56*r*, approximately the same size and shape as the opening 46*r*, and a central pivot 58*r* (visible as the corresponding 581) directly opposite the pivot hole 48r.

Assembly proceeds as follows. The rotatable top 50*r* is snapped onto the lid 40*r*. Preferably, the pivot 58*r* is made longer than the depth of the pivot hole 48*r* and tapers outward at the end so that the rotatable top 50*r* does not easily fall off the lid 40*r*, but can still rotate about the pivot 58*r*. Preferably the sleeve 42*r* extends in the direction of the rotatable top 50*r* as far as the thickness of the plate 52*r* and the diameter of the plate 52*r* is large enough to form an interference fit with the inner diameter of the sleeve 42*r* so that the rotatable top only rotates when, e.g., the protrusion 54*r* is pushed.

Next, the container body 30*r* is filled with a condiment of choice and the lid 40*r* is press fit onto the body. Preferably, the outer diameter of the body 30*r* and the inner diameter of the sleeve 42*r* provide an interference fit so that the lid does not easily fall off the body 30*r*. This can also be adjusted by varying the length of the sleeve 42*r* in the direction of the container body 30*r*.

Lastly, the body 30*r* with lid 40*r* and secured rotatable top 50*r* are rotated so that the protrusions 36*r* are aligned with the slots 26*r*, pushed down the slots, and rotated (clockwise as illustrated) to engage the slots 28*r*. Preferably, the side of the slots 28*r* toward the container 30*r* make a slight angle, e.g., five degrees, toward the rib 24. With proper dimensions, when the body 30*r* is rotated, the tapered slots 28*r* and rib 24 creates a compressive force on the protrusions 36*r* and provides enough friction so that the body 30*r* does not easily rotate and become unlocked. FIG. 2 illustrates an assembled dispenser. Other orders of assembly can also be used. It should be obvious from the drawings that, by rotating the rotatable top to various positions, the rate at which condiment can be dispensed can be controlled. When not dispensing condiments, the hole 14 in the handle rod 12 can be used to hang the dispenser on a peg on a wall or a hook on a barbecue grill.

A prototype working example was constructed generally in accordance with FIGS. 1 and 2. While not attempting to be a production specification, the following dimensions may assist in visualizing the example, namely,: 1) the length of the handle 10 was 9" and had a 0.75" diameter, 2) the outside diameter of the container holder sleeve 12 was 2.500" with a wall thickness of 0.125" and a length or 1.5", 3) the outside diameter of the container body 20 was 2.375" with a 0.125" wall and a length of 2.35", 4) the lid skirt 42*r* was 0.5" long with 0.0625" diameter holes 47*r*, and 5) the rotatable top was 0.0625" thick. The material used was a polycarbonate plastic. Note that, the scale in FIG. 2 is about 0.57:1.

When used with a standard 18 inch barbecue grill, it was found that it was possible to reach all areas with minimal exposure to heat.

It was also discovered that the force and effort required to dispense condiments was considerably less than with currently available dispensers. Quite apart from barbecuing, that was the original motivation for the invention, it may be useful for those suffering from arthritis or any other impairment that limits strength or mobility in the arm. While not being bound by any theory, it is believed this is due to the following.

Shaker-type condiment dispensers that dispense grains or particles are almost always supplied with small holes corresponding to the holes 47*r* of the present invention. It is believed that the hole sized is adjusted so that it is larger that the largest grain or particle, but not much larger. If the dispenser is turned over gently, few grains come out because the mass of grains jam up behind the holes. If the dispenser is held at an angle and rocked back an forth, some particles acquire enough velocity to exit the holes before the mass arrives. The amount of condiment dispensed can be controlled by shaking with more or less vigor. If the holes are made large enough or the dispenser angle approaches the vertical, less vigor is required, but less control is possible.

In the present case, a standard salt shaker uses 0.078" holes, while this one used 0.0625" holes. In spite of the smaller hole size, the effort to shake out salt was subjectively estimated to be considerably less than for a standard shaker. This is because, instead of rotating the entire forearm around the elbow, only a gentle wrist motion is required to move the relatively light handle. In the case of osteoarthritis, that usually affects the hand, operation is just the opposite. A very limited trial indicates that condiments can be dispensed by gently moving the entire arm about the shoulder while keeping the hand and wrist fixed. The small diameter handle, compared to the body diameter of a standard shaker, is also easier to grip. As an overall result, the present invention produces less physical strain.

Another benefit discovered was increased control of dispensing volume and placement, especially in a barbecue setting. With a standard dispenser, with an arm extended, it is difficult to see under the dispenser unless the forearm is held at an angle to the line of sight. With this invention, the small diameter handle makes it possible to see with a relatively unobstructed view. It is also easier to grip for children.

Having described and enabled one embodiment of the invention, it should be pointed out that the scope of the invention is not limited to the single embodiment. For example, since the invention is directed to a mass market, rather than machined parts, injection molded plastic would most likely be used. To save on parts, at the expense of demountability, the handle 10, holder 20 and container bodies 30 could be an integral piece. Although the disclosed design is thought preferable for use with barbecues, there are a plethora of designs that could be used for lids 40 and rotatable tops 50. One simple design uses a metal screw-on top with dispensing holes only. Others use hinged lids and/or sliding tops. There could be more than two containers, e.g., four at 90°, or only one. With suitable design changes to the container body and lids, well within the routine design skill in the art, they could be made stackable. This could be done by extending the sleeves 42 past the rotatable tops 50 and providing slots in the sleeves 42 to accommodate the protrusions 36 of other dispenser bodies 30.

An important part of the invention is a handle that provides additional reach and force multiplication. In order to be effective, the handle must be long enough so that it is not a mere handhold. While there is no standard width of the palm of a hand, force multiplication is expected to become significant when the length is six inches. Since barbecues are eighteen inches in diameter or more, a length of at least nine inches is desirable. Instead of the rod illustrated herein, that is easy to machine, injection molded plastic could be used to produce a more complex design as long as the distance from the hand to the containers is sufficient. The handle and the axis of the containers need not be at right angles.

It may be desirable to retain the feature of demountable containers. One could have several container bodies, each pre-loaded with a different condiment that could be used with a single handle. There are other ways to create the demountable feature. The holder 20 could have inside grooves instead of slots all the way through, since, although difficult to machine, it is feasible with injection molded plastic. As an alternative, screw threads could be used with the container screwed into the holder. A holder with elastomeric rings providing friction and compression could be used for both round and odd-shaped containers. For instance, a triangular shape may have aesthetic appeal. For off-the-shelf odd-shaped containers, an expandable ring, similar to a common hose clamp, having slits that engage the threads of a tensioning screw could be used. The major requirement for a demountable holder is that the container can be securely held for use as a dispenser.

Figure 3A:
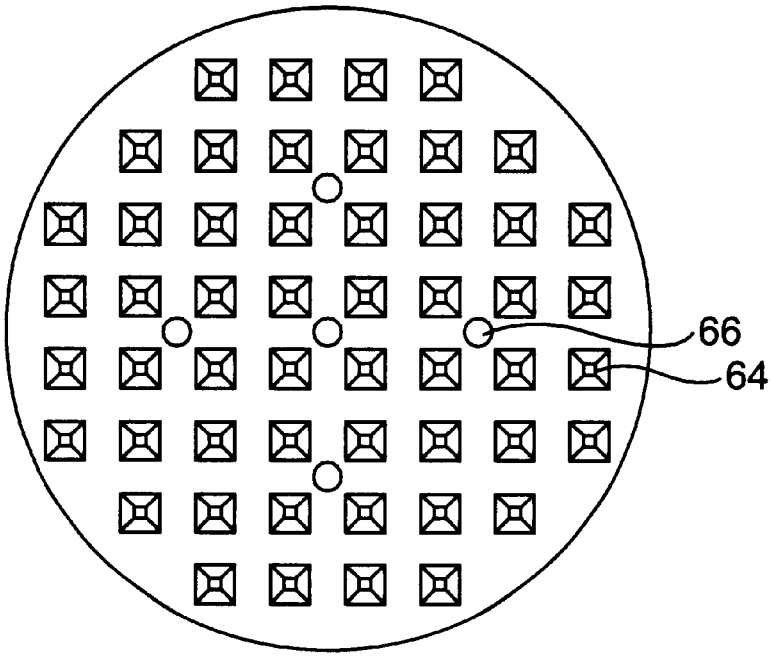
FIG. 3*a* shows a top view of a lid that can be used to make a combination tenderizer and marinader.
Figure 3B:
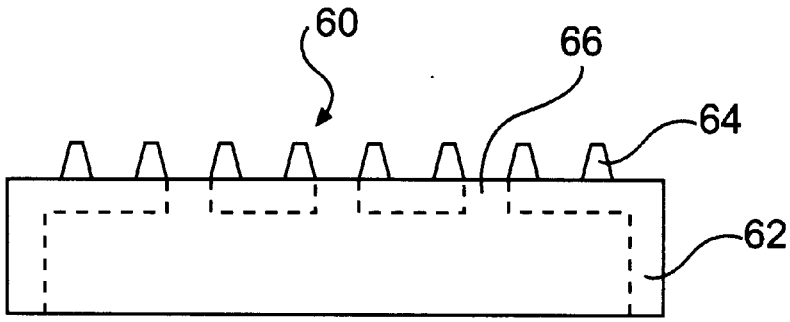
FIG. 3*b* shows a cross-sectional view of a lid shown in FIG. 3*a*.

In another embodiment of the invention, a combination tenderizer and marinader (to coin a word) is provided as illustrated in FIG. 3. This shows a replacement lid 60 having pyramidal protrusions 61 and holes 62. In operation in conjunction with the previous embodiment, shown in FIG. 2, after filling the container body 30 with a marinade, the lid 40 and rotatable top 50 are replaced with the tenderizer/marinader lid 60. Then the device is used as a normal tenderizer while, in the process, marinade is dispensed. For this use, since tenderizing is normally not attempted on a grill, the length of the handle is primarily to provide additional momentum. Of course, the exact design illustrated in FIG. 3 need not be followed as long as lid 60 has a plurality of protrusions and at least one hole.

Another use for the invention where handle length is important is in a normal kitchen. The invention is useful for flavoring foods being cooked inside an oven. This is particularly useful where a large area, such as for a casserole, must be covered. Although polycarbonate with a melting temperature of at least 450° and a useful service temperature of 250° F. was used in the working example, other materials are available with higher service temperatures.

Other design changes within the scope of the invention will occur to those skilled in the art, but it is intended that the scope is limited only by the claims.

What is claimed is:

1. An article for dispensing condiments comprising:

at least one container capable of dispensing condiments;

a long handle secured to said at least one condiment container; and securement structure selected from a group consisting of a groove type wherein said groove type comprises a sleeve secured to one end of said handle, said sleeve further having internal L-shaped grooves and said at least one condiment container further having outwardly extending protrusions that engage said grooves, screw type, tension-band type, and friction type.

2. The dispenser of claim 1, wherein said handle has a hand grip ending at least about six inches from said at least one condiment container.

3. The dispenser of claim 1, wherein said handle has a hand grip ending at least about nine inches from said at least one condiment container.

4. The dispenser of claim 1 wherein said securement structure is the groove type that comprises a sleeve secured to one end of said handle, said sleeve further having internal L-shaped grooves and said at least one condiment container further having outwardly extending protrusions that engage said grooves.

5. The dispenser of claim 4, wherein said sleeve further has an in internal circumferential ring arranged to provide a compressive force on said at least one container.

6. The dispenser of claim 4, wherein said grooves in said sleeve extend through said sleeve forming slots.

7. The dispenser of claim 1 wherein said securement structure is the screw type that comprises a sleeve secured to one end of said handle, said sleeve having internal screw threads, said at least one condiment container having external screw threads, whereby a screw thread coupling is formed between said sleeve and said at least one condiment container.

8. The dispenser of claim 1 wherein said securement structure is the tension band type that comprises a tension band secured to one end of said handle, said tension band having an adjustment mechanism, whereby said at least one condiment container can be secured to said handle.

9. The dispenser of claim 1 wherein said securement structure is the friction type that comprises a sleeve secured to one end of said handle, said sleeve having an inner elastomeric friction generating surface, whereby said at least one condiment container can be secured inside said sleeve.

10. The dispenser of claim 9, wherein said sleeve is cylindrical.

11. The dispenser of claim 9, wherein said sleeve and said at least one condiment dispenser have a triangular cross section.

12. The dispenser of claim 1, wherein at least one of said condiment dispensers further has a lid having at least one lid hole for dispensing condiments and a rotatable top affixed thereto having at least one top hole whereby rotation of said top provides control of the rate at which condiments are dispensed.

13. The dispenser of claim 1, wherein at least one of said condiment dispensers has a lid having a plurality of protrusions and at least one hole.

14. The dispenser of claim 1, further comprising a plurality of containers that are stackable.

15. The dispenser of claim 1, wherein the elements are substantially made from plastic.

16. An article for dispensing condiments comprising:

a) a handle comprised of a rod having, at one end, a hole therethrough and having another end;

b) a cylindrical sleeve secured to the other end of said rod with its axis at right angles to said rod, each end of said sleeve having two slots approximately parallel to said sleeve axis located opposite each other and extending from said sleeve ends toward the middle, each slot meeting a slot at right angles to said axis parallel slots, and further, said sleeve having a circumferential inwardly extending ridge located in the middle of said sleeve;

c) two demountable condiment containers comprised of:

i) a cylindrical body closed on one end and open on another and having protrusions located to match said slots in said sleeve and extending radially outward, ii) a lid having at least one hole; and iii) a rotatable top having at least one hole.

17. The dispenser of claim 16, wherein the elements are substantially made from plastic.

18. An article for tenderizing food and dispensing condiments comprising:

a) a long handle comprised of a rod having, at one end, a hole therethrough and having another end;

b) a cylindrical sleeve secured to the other end of said rod with its axis at right angles to said rod, each end of said sleeve having two slots approximately parallel to said sleeve axis located opposite each other and extending from said sleeve ends toward the middle, each slot meeting a slot at right angles to said axis parallel slots, and further, said sleeve having a circumferential inwardly extending ridge located in the middle of said sleeve;

c) at least one demountable tenderizer/marinader comprised of:

i) a cylindrical body having a solid bottom and open top and having protrusions located to match said slots in said sleeve and extending radially outward, ii) a lid having a plurality of protrusions and at least one hole, whereby food may be simultaneously tenderized and marinaded.

* * * * *